US008403022B2

(12) United States Patent
Womacks

(10) Patent No.: US 8,403,022 B2
(45) Date of Patent: Mar. 26, 2013

(54) GARAGE DOOR OPENER GUARD

(75) Inventor: William Womacks, Tucson, AZ (US)

(73) Assignee: William Womacks, Tucson, AZ (US)

( * ) Notice: Subject to any disclaimer, the term of this patent is extended or adjusted under 35 U.S.C. 154(b) by 0 days.

(21) Appl. No.: 13/302,028

(22) Filed: Nov. 22, 2011

(65) Prior Publication Data

US 2012/0138240 A1 Jun. 7, 2012

Related U.S. Application Data

(60) Provisional application No. 61/419,581, filed on Dec. 3, 2010.

(51) Int. Cl.
*E05D 15/16* (2006.01)

(52) U.S. Cl. ..... 160/201; 160/188

(58) Field of Classification Search ..... 160/201, 160/188; 292/DIG. 2, DIG. 36, 346; 16/412; 70/54, 55, 56; 248/551
See application file for complete search history.

(56) References Cited

U.S. PATENT DOCUMENTS 3,435,558 A 4/1969 Kruse
3,788,688 A 1/1974 Chandler
4,847,542 A 7/1989 Clark et al.
5,533,561 A 7/1996 Forehand
6,089,626 A 7/2000 Shoemaker
6,273,174 B1 * 8/2001 Singleton ..... 160/201
6,325,134 B1 12/2001 Mullet
6,782,662 B2 8/2004 McCartney et al.
6,878,889 B1 4/2005 Horst et al.
2003/0121619 A1 7/2003 Szpur
2012/0019011 A1 * 1/2012 Laborde ..... 292/1
2012/0043030 A1 * 2/2012 Shepherd et al. ..... 160/188

OTHER PUBLICATIONS

First Watch Security, Description of SecureShield device, available at http://www.firstwatchsecurity.com/SecureShield.
Garage Guard, Description of Garage Guard Anti-Theft Device, available at http://www.thegarageguard.com/?q=home.

* cited by examiner

*Primary Examiner* — Blair M Johnson
*Assistant Examiner* — Jaime F Cardenas-Garcia
(74) *Attorney, Agent, or Firm* — Yakov Sidorin; Quarles & Brady LLP

(57) ABSTRACT

A security device and method for a garage door opening system mounted within the dwelling, for preventing an unauthorized access to the garage door opening system from outside of the garage and mechanically disconnecting the carriage assembly of the system from the remaining part of the system by pulling the release cord toward the garage door.

7 Claims, 8 Drawing Sheets

GARAGE DOOR OPENER GUARD

CROSS REFERENCE TO RELATED APPLICATIONS

This application claims the benefit of and priority from the U.S. Provisional Patent Application No. 61/419,581 filed on Dec. 3, 2010 and titled "Overhead Garage Door Security," which is incorporated herein by reference in its entirety.

TECHNICAL FIELD

The present invention relates to a system and method of preventing access to the carriage assembly of the automatic garage door opener and, in particular, to a device and method of protecting the manual trip cord of such door opener from being pulled from outside the garage.

BACKGROUND ART

Garage door operating systems that directly connect to sectional garage doors are well known and must have a manual disconnect mechanism that allows such operating system to be disconnected from the door. The disconnect mechanism is required to make it possible to operate the door manually in the case of power failures, fire, or emergency situations where entrapment of a person or object occurs in the garage. In these instances, the disconnect mechanism operates to allow manual displacement of the door to make it possible, for example, to enter or exit the garage. The majority of motorized operating systems for residential garage doors employ a carriage (or trolley) type operating system, which applies force to a section of the door powering it between the open and closed positions.

In a carriage-type operating system, the manual disconnect mechanism typically includes a disconnecting means such as emergency release cord, rope or bar extending from the carriage (also referred to as a carriage assembly). Such disconnecting means (and an optional handle affixed to it) is required to extend within six feet of the garage floor to permit grasping and actuation by a person from inside the garage. In terms of security, the carriage's movement places the release cord, for example, in a proximity to the garage door when the garage door is closed. When windows are added to the top section of the garage door, a window may be broken, and the release cord, easily within the reach of an intruder, may be snagged and pulled towards the garage door thereby causing a manual opening of the garage door. Similar problem exists even in absence of the garage door windows, because a slot-like opening is often present above the upper section of the garage door, through which the intruder can reach the release cord.

SUMMARY OF THE INVENTION

Embodiments of the present invention provide a garage door security device for use with a garage door opening system having a carriage assembly located at and movable along a track along a ceiling of a garage and attached to a garage door via a connecting arm, the carriage assembly including a release lever adapted to disengage the carriage assembly from the garage door and a release connector affixed to a distal end of the release lever. Such security system includes a housing shell having an inner volume defined by walls of the housing shell and an aperture defined by edges of the housing shell. The aperture is generally dimensioned to receive a portion of the carriage assembly including at least a release lever. The housing shell is configured to conceal the portion of the carriage assembly received through the aperture in the inner volume such as to prevent the release lever from being activated from outside of the housing shell. The housing shell includes an opening in its wall, which opening spatially corresponds to the distal end of the release lever and is configured as a conduit for the release connector from the distal end to an outside of the housing shell. The opening in a wall of the housing shell may include a slit extending from the aperture towards another wall of the housing shell and, in one embodiment, may have a perimeter.

In one embodiment, the security device may additionally include an attachment means configured to attach the housing shell to the connecting arm of the garage door opening system. Furthermore, in a specific embodiment the housing shell of the security device is configured to entrap the release connector and to prevent it from being pulled towards the garage door to activate the release lever, when the housing shell is attached to the garage door opening system, such as (i) to receive this portion of the carriage assembly through the aperture, (ii) to conceal this portion in the inner volume, and (iii) to have the release connector pass through the conduit associated with the opening in a wall of the housing shell to have a distal end of the release connector hand outside of the housing shell. In one embodiment, the housing shell further may incorporate a flap and be attachable (for example, tensionably) to the connecting arm through such flap.

Embodiments of the invention also provide a system for opening a door of a garage. Such system includes a track, a truck slidably mounted on the track and connected to the door with a connecting member, an operating means configured to slide the truck along the track, and a release lever having proximate and distal ends and pivotally connected to the truck at the proximate end, which release lever is configured to manually release the door from the operating means. In addition, the system includes a housing shell having an inner volume (defined by walls of the housing shell), an aperture (defined by edges of the housing shell), and an opening in a wall of the housing shell. The aperture is generally dimensioned to receive a portion of the truck and a release lever. The system additionally includes a release connector attached to the distal end of the release lever. The housing shell is generally removably disposed in mechanical communication with the release lever such as (i) enclose the release lever received through the aperture in the inner volume, (ii) to cause the release connector freely extend downward from the distal end of the release lever through the opening and outside of the housing shell, and (iii) to prevent a deflection of the release lever when the release connector is pulled towards the door. The housing shell may be attached to the connecting member and is tensionable against the connecting member. In one embodiment, the housing shell may be disposed such as to prevent access to the release lever from the door. In a specific embodiment, the housing shell is in mechanical communication with the release lever such as to conceal the release lever from being reachable from outside of the housing shell. The opening in a wall of the housing shell is generally adapted to entrap the release connector when the release connector is being pulled towards the door.

BRIEF DESCRIPTION OF THE DRAWINGS

The invention will be more fully understood by referring to the following Detailed Description in conjunction with the Drawings, which are generally presented not to scale and of which.

DETAILED DESCRIPTION

In normal situations, a carriage-type door operating system directly connects to the top section of a segmented garage door and may be powered to operate doors of vastly different sizes and weights, with little or no assistance from a counterbalance system. As its name suggests, the carriage-type mechanism has a carriage that operatively connects the top section of the door to the motor. As the door moves between the opened and closed positions, the carriage (or carriage assembly) translates along a track toward the rear and front of the garage, respectively. The emergency release cord (or release cord, for short) for carriage-type operating system is typically suspended from the carriage and operates to disconnect the operating system from the top door section.

The release cord and handle must extend within six feet of the floor to permit grasping and actuation by a person. In the case of a garage opening for a single car, the centrally-located release cord and handle, being positioned medially, can catch on a vehicle during movement or be difficult to reach due to its positioning over a vehicle located in the garage. In terms of security, the carriage's movement places the release cord closest to the garage door opening when the garage door is closed. In the majority of garage door designs, either a windows is added to the top section of the garage door or a slot-like opening can be formed between an upper section of the garage door and the door-frame header. Through such window or opening, the release cord can be reached from outside the garage, snagged, and pulled towards the door by the intruder such as to separate the operator from the door preparatory to manually opening the garage door.

Figure 1A:
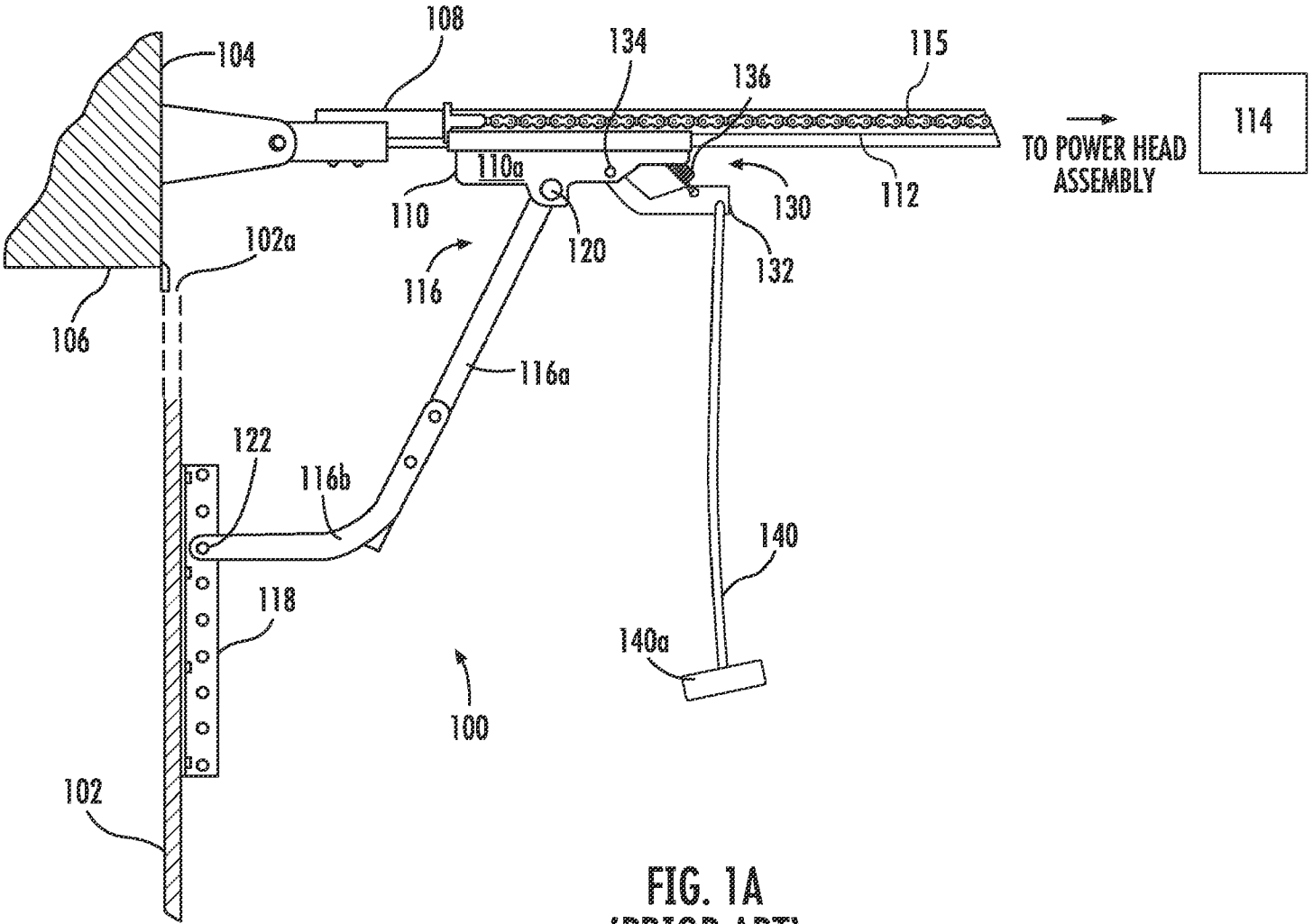
FIG. 1A (PRIOR ART)
FIG. 1A is a side elevational view of a typical garage door opening system.
Figure 1B:
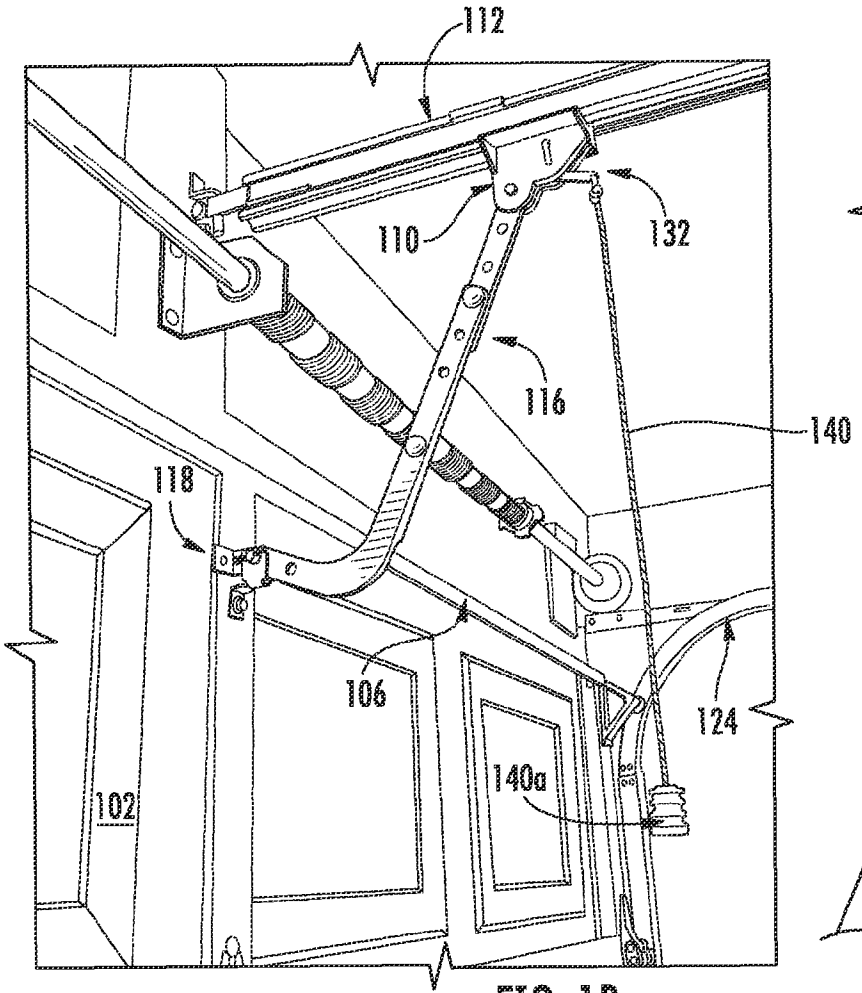
FIG. 1B (PRIOR ART)
FIG. 1B is a perspective view of a garage door opening system.

FIG. 1A is a side view of a typical garage door opening system (or garage door opener) 100 that includes a sectioned garage door 102 (in its closed position, as shown), installed within an abode 104 having a door-frame header 106. FIG. 1B provides a perspective view of the system 100. The system 100 is affixed to the abode 104 with some affixing means such as an anchor 108, for example, and is operatively engaged with the garage door 102 to allow this door to open and close. Typically, either a small space (such as a slot) is present between the door 102 and the header 106 or an optional window 102*a* is installed as part of an upper section of the door 102. The garage door opener 100 usually includes a truck (or carriage) 110 slidably mounted on a track or rail 112, and an operating means such as, for example, a power head assembly 114 adapted to pull the truck 110 in combination with a chain (or, in some embodiments, a screw drive) 115 (to which the truck 110 is disengagingly connected) rearwardly, towards the power heads assembly 114, to open the door 102. A portion 110*a* of the truck 110, which, in operation, is configured to transversely extend below the track 112, is pivotally attached to an arm 116. (As shown in FIG. 1A, the arm 116 may include a straight arm portion 116*a* and a curved arm portion 116*b*.) The arm 116, in turn, is usually pivotally attached to the door 102 through a door bracket 118 that is adapted to ensure that the arm 116 can be attached to the door 102 at different positions. The pivots 120, 122 ensure that the door 102 can be pivotally pulled rearwardly along the track 112 (generally, along the z-axis) and auxiliary guide(s) 124 at the side(s) of the door 102, and also returned forwardly to its closed position.

In further reference to FIGS. 1A, 1B, a release (or disconnect) mechanism 130 that includes an emergency release lever 132, pivotally mounted on the truck 110 at an axis 134. A spring 136 connects and biases the release lever 132 to the truck 110 such as to cause a return of the release lever 132 in its initial position once it has been pulled downwards (generally along the y-axis). Activation and operation of the release lever 132 requires having it pulled downwards below a certain threshold, as a result of which the truck 110 is caused to disconnect from the chain or screw drive 115 and the door 102 can be moved up and down manually. In a typical garage the release lever 132 is located well above the reach of a user, under the garage ceiling. Therefore, an emergency releasing means such as, for example, a release connector 140 (such as a cord, a bar, or a chain, for example) optionally having a handle 140*a* is attached to an end of the release lever 132 to allow a person standing on the garage floor to operate the release lever 132 by pulling the release connector 140. Unfortunately, the same releasing means (at least one of the release lever 132 and the release connector 140) can be reached by an intruder from outside the garage through a window 102*a* or a slot between the door 102 and the garage-frame header 106 with an appropriate extended item adapted to hook to and pull the releasing means, thereby disconnecting the door 102 from the garage-door opening system 100 and manually gaining access to the garage.

Figure 2:
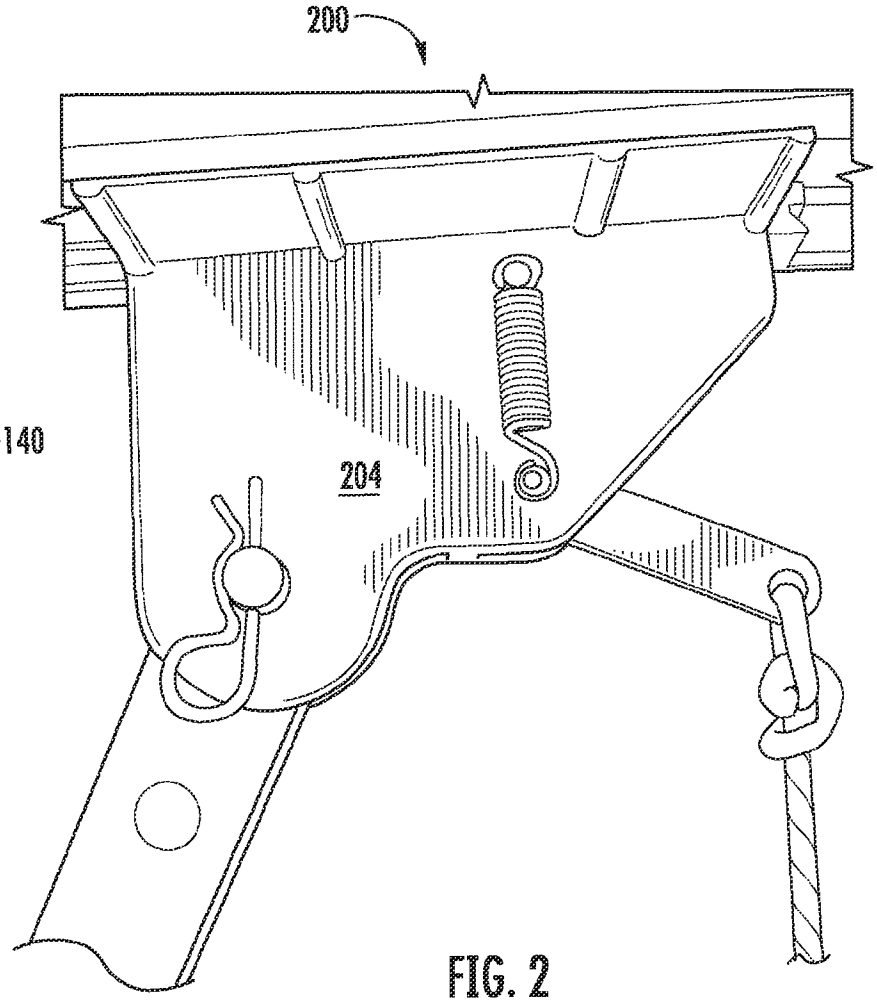
FIG. 2 (PRIOR ART)
FIG. 2 is a side perspective view of a truck of a garage door opening system.

Solutions were proposed to protect the releasing means from being exposed to an outside-located intruder. One solution includes, for example, a pair of security plates mounted to either the truck 110 and/or the track 112 and extending vertically alongside the release lever 132 such as to sandwich the release lever 132 and/or to position the truck 110 between the security plates when the door 102 is fully closed. While this solution protects the release lever such as the lever 132, it leaves the release connector 140 vulnerable in that does not protects the release connector 140 from being grabbed with the intruding extended item and from being pulled towards the garage door 102, such as to cause the release lever 132 to yet again disconnect the door 102. In other words, the solutions of the related art remain deficient in that they do not solve the abovementioned problem. One of the challenges to solving this problem stems from the fact that different implementations of tracks and carriage assemblies of different garage door opening assemblies have different dimensions and/or shapes and configurations. Indeed, FIG. 2, for example, shows a related implementation 200 of the truck of the garage door opening system, in which a portion 204 of the truck 200 that extends transversely to the track 112 has sufficiently wider area and is shaped differently as compared to the portion 110*a* of the truck 110 of FIG. 1A. It is understood that the door opening system employing the embodiment 200 is prone to the same high-jacking intrusion. The challenge in solving the problem is further compounded by the realization that any piece of hardware affixed to the truck of the assembly adds weight that contributes to mechanical instability of the truck/track combination, especially if the method of affixing hardware to the truck includes applying mechanical tension to the truck.

In accordance with embodiments of the present invention, methods and apparatus are disclosed for protecting a release connector of the carriage-assembly based garage door opening system such as the system 100 of FIGS. 1A, 1B from being engaged or snagged from an outside of the garage and activated, i.e., from being pulled sufficiently to cause the release lever 132 to disengage the truck 110 from the remaining portion of the door opening system 110.

Figure 3A:
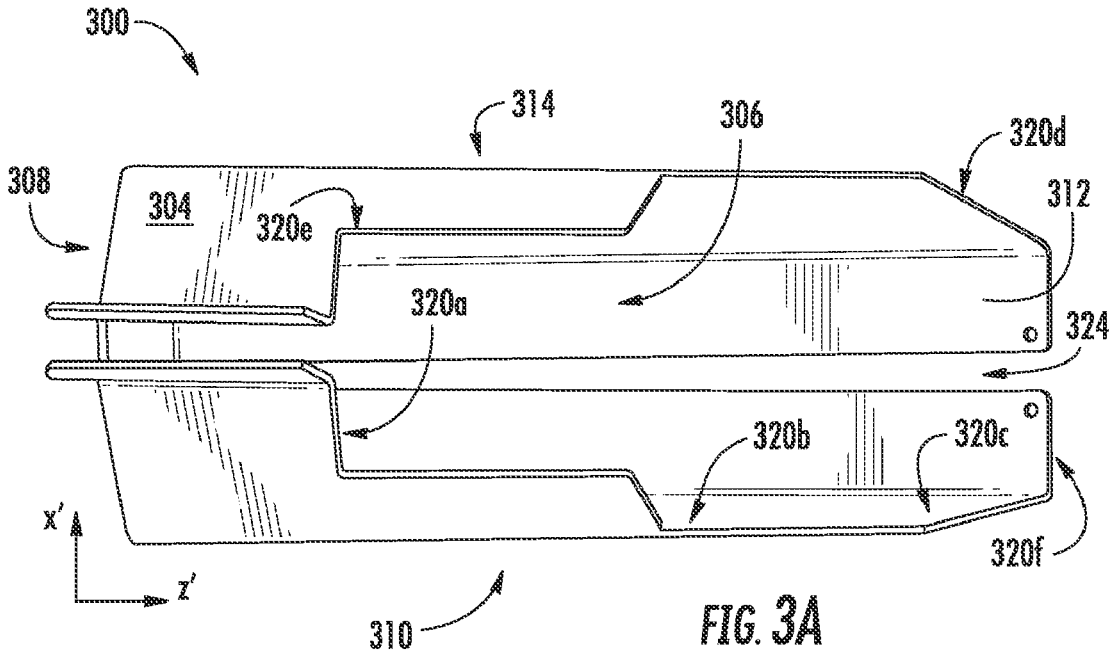
FIGS. 3A, 3B, 3C are a top elevational view, a side elevational view, and a bottom perspective view of an embodiment of the present invention.
Figure 3B:
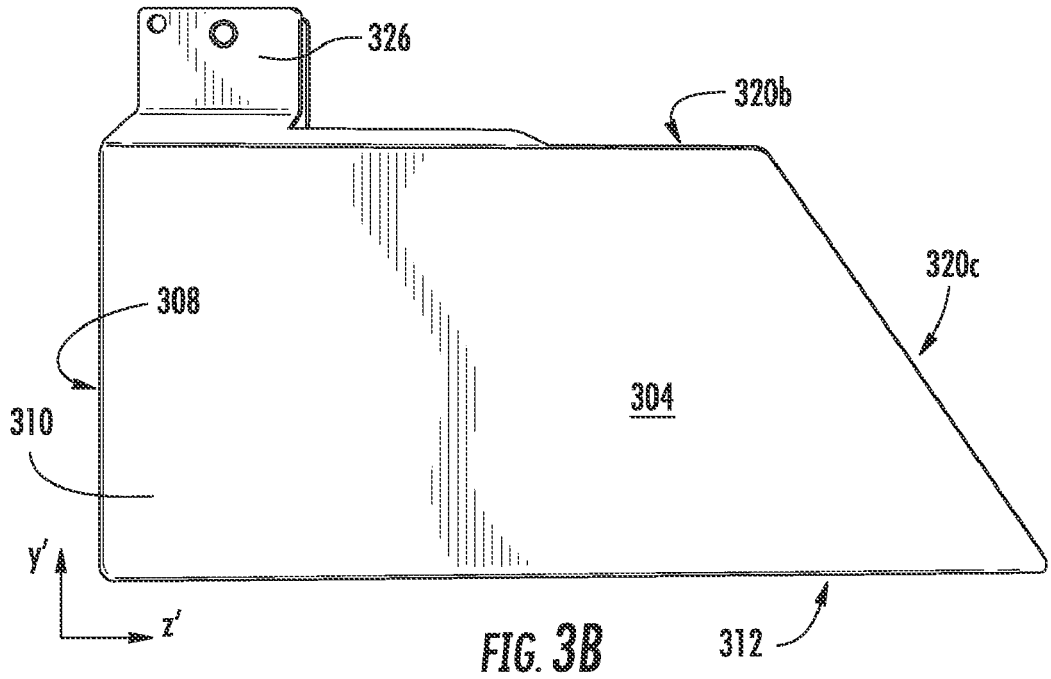
Figure 3C:
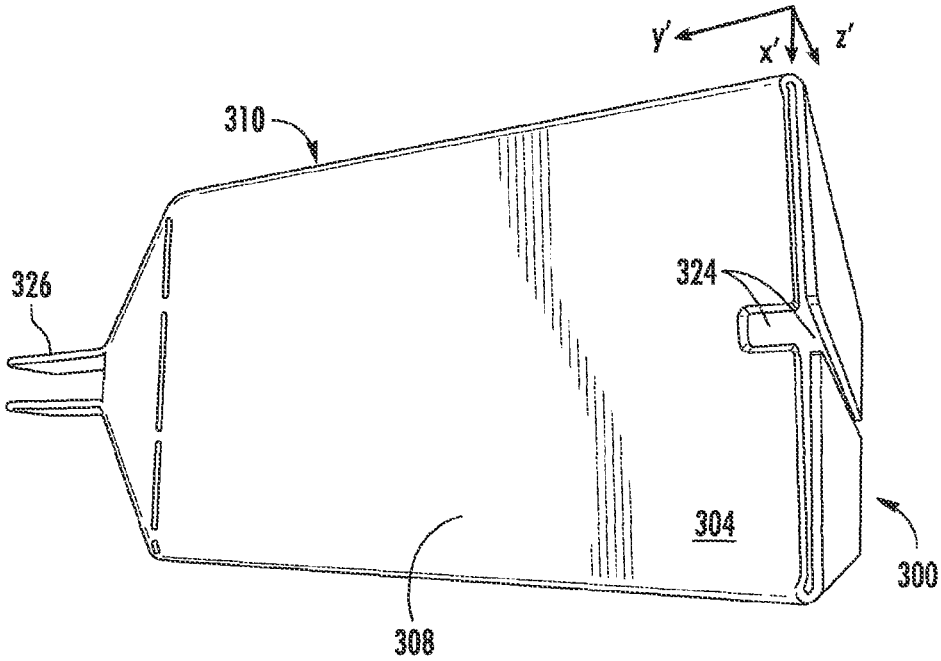

In reference to FIGS. 3A, 3B, and 3C, an embodiment of the present invention includes a security device with housing structure 300 having a shell 304 with an inner volume 306 defined by walls 308, 310, 312, 314 and an opening or aperture defined by edges 320*a*, 320*b*, 320*c*, 320*d*, 320*e*, 320*f*. At least one of the walls 308, 310, 312, 314 is configured to contain opening(s) 324 (interchangeably referred to herein as slit(s) or cleft(s) or split(s)) that are dimensioned to allow the release connector 140 to pass through and into the split(s) 324. Optionally, the housing structure may also include an attachment flap 326, as discussed below. As shown in FIG. 3B, the edges 320*c*, 320*d* are slanted or inclined with respect to the lower wall (or bottom) 312. It will be appreciated, however, that such inclination may be dependent on a particular shape of the truck 110 and/or a cover of the power head assembly and, in general, is not required. Moreover, in a related embodiment, at least a portion of a side of the housing structure 300 defined by the edges 320*c*, 320*d* may be closed and/or covered with another side wall.

As is discussed further below, an embodiment of the housing structure is configured to cover and accommodate inside the inner volume of the housing structure 300 at least a portion of the truck of a door opening system such as, for example, the portion 110*a* of the truck 110 of FIGS. 1A, 1B (or, in reference to FIG. 2, the portion 204), while at the same time allowing the emergency release connector 140 to pass, from the lever 132 that is now lodged inside the housing structure 300, outwards and through the split 324.

Figure 4A:
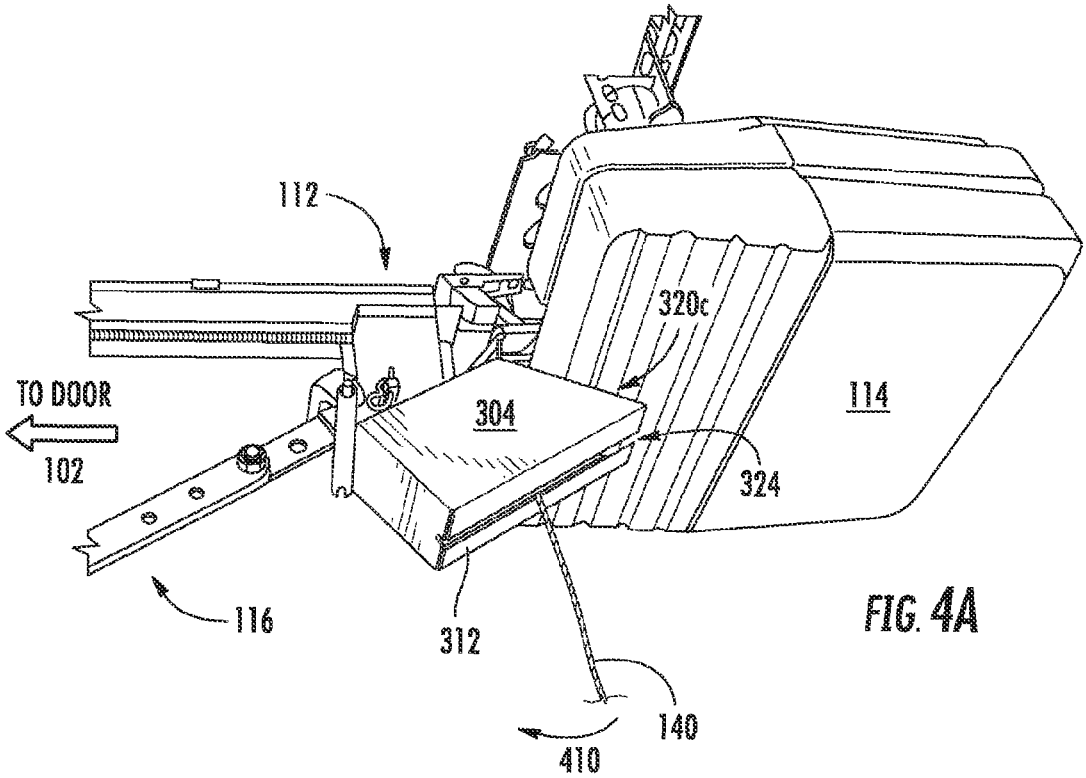
FIG. 4A is a side perspective view of a carriage assembly, in a refracted position, of a garage door opening system cooperated with an embodiment of the present invention.
Figure 4C:
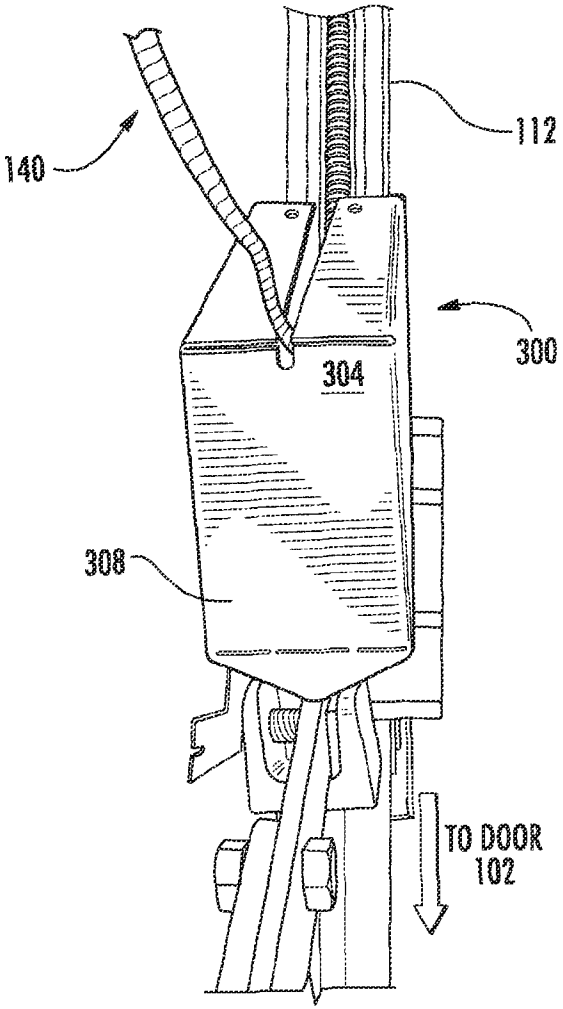
FIG. 4C is a side perspective view of a carriage assembly of a garage door opening system cooperated with an embodiment of the present invention, in a position corresponding to the door being closed.
Figure 4B:
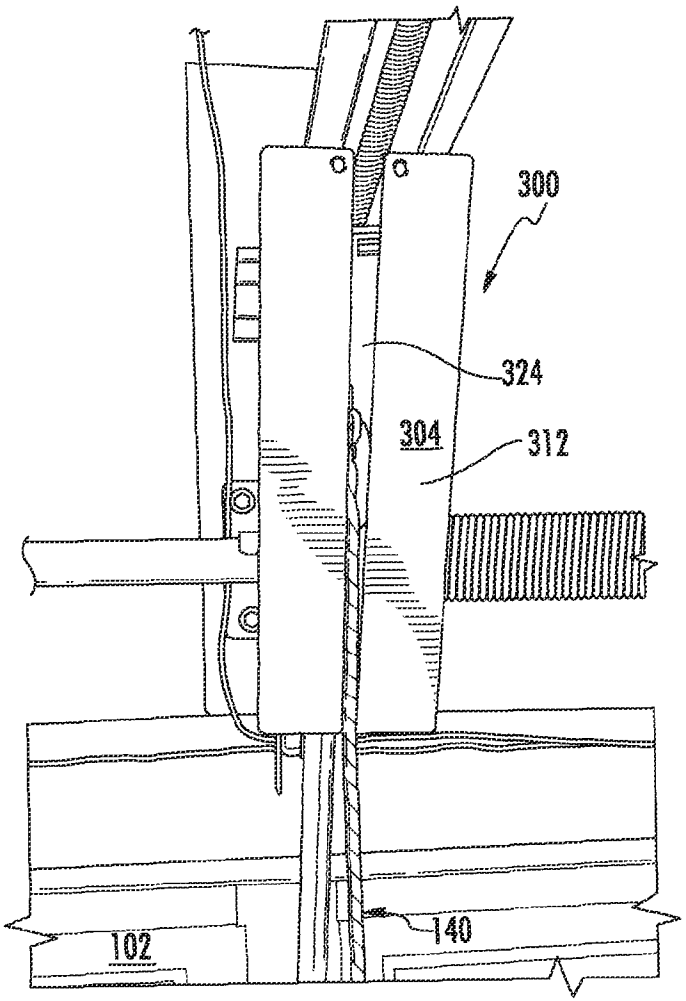
FIG. 4B is a bottom perspective view of a carriage assembly of a garage door opening system cooperated with an embodiment of the present invention, in intermediate position between the garage door and the refracted position.

Referring now to FIGS. 4A through 4C, showing the embodiment 300 being mechanically cooperated with the truck 110 of the door-opening system 100 of FIGS. 1A, 1B, and in further reference to FIG. 3C, the slit(s), cleft(s) or split(s) 324 in the walls 308, 312 of the embodiment 300 are preferably spatially coordinated with one another and dimensioned to ensure that the connector 140, freely hanging from the lever 132 (that is now housed inside the structure 300) through the split(s) 324, is restricted by the split(s) 324 from being moved laterally (in a direction transverse to the track 112) and/or from being pulled in the direction towards the door 102. This will be further discussed below. Entrapment and restriction of the motion of the release connector 140 by the split(s) 324 in the housing structure of the guard that has been operably attached to the truck of the door opening system causes a restriction of motion of the lever 132, which in turn prevents the truck from being disengaged from the chain or screw drive 115.

It is appreciated that, once an embodiment of the housing structure such as the embodiment 300, for example, is affixed to the truck 110 of the assembly 100, the spatial and functional relationship between the housing structure 300, the truck 110, the release lever 132, and the release connector 140 remains substantially unchanged and does not depend on operation or a particular state of the door opening system 100. Specifically, both in a fully advanced position of the door operating system 100 (with the door 102 being closed and the truck 110 covered with the housing structure 300 being in proximity to the door frame) and a refracted position of the door operating system 100 (with the door 102 being pulled up and the truck 110 being stationed at a distal end of the track 112 in proximity to the power head assembly 114), the release connector 140 passes from the free end of the lever 132 hidden insider the housing structure 300 through the split 324 that runs along the lower wall 312 of the housing structure 300. FIG. 4A provides a perspective view of the assembly in its refracted position. The split 324 in the lower wall 312 entraps the release connector 140 and, in combination with the side wall 308, prevents the connector 140, when reached through the door 102 (not shown), from being pulled towards the door in a motion schematically indicated by an arrow 410. As further shown in FIG. 4A, the inclination of the edges 320*c*, 320*d* of the embodiment 300 with respect to the lower wall 312 facilitates the spatial articulation between the embodiment 300, cooperated with the truck 110, and the cover of the power-head assembly 114 in such a way as not to collide a portion of the installed embodiment 300 that is distal to the door 102 with the power head assembly 114. FIG. 4B provides a bottom perspective view of the installed embodiment 300 in an intermediate, partially refracted position of the door opening system 100. FIG. 4C demonstrates another perspective view of the installed embodiment 300 in a fully advanced position, when the truck 110 is in its closest position with respect to the door 102.

Figure 5:
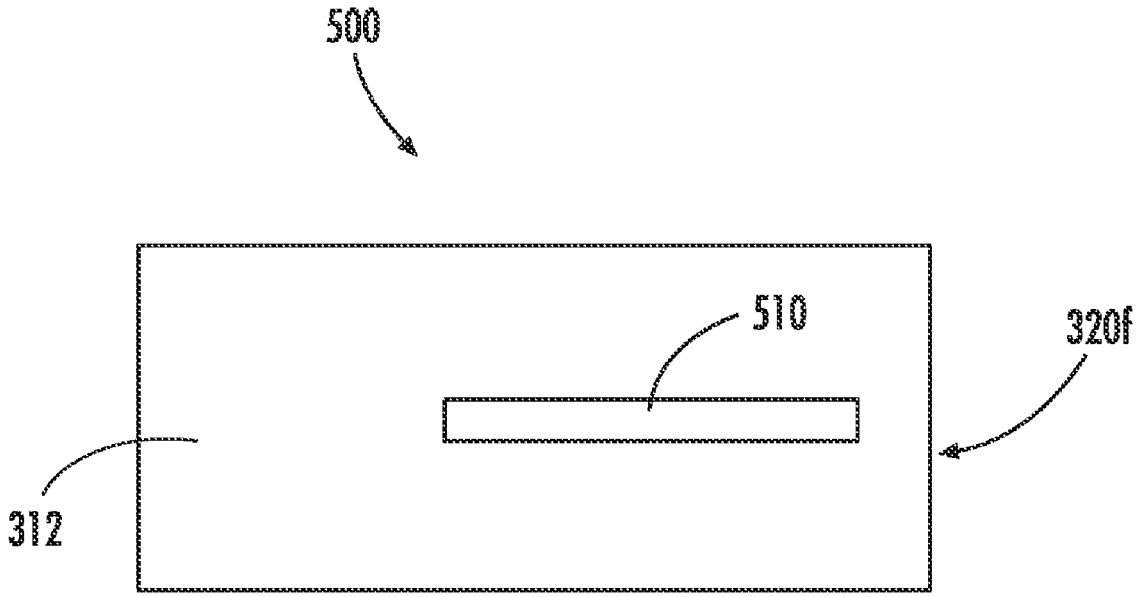
FIG. 5 is a bottom view of an alternative embodiment of the present invention.

Referring again to FIGS. 3A-3C and 4A-4C, while the split or opening 324 is shown to traverse substantially the whole length of the wall 312, it is understood that in a different embodiment (not shown) a split of a different length may be employed. In one related embodiment, for example, a split similar to the split 324 may be used that extends only along a portion of the wall 312 from an open edge 320*f* towards the wall 308, with no accompanying split in the wall 308. In another embodiment, a portion 500 of which is shown schematically in FIG. 5, the lower wall 312 has an opening 510 having a perimeter and closed ends, neither of which reaches an edge of the wall 312.

Similarly, the scope of the present invention does not depend on a particular shape of the openings such as the openings 324, 510, which may be rectangular (as shown in FIGS. 3A-3C, and 5), wedge-like, or any other appropriate shape. In combination, the length of the wall 312, and/or the wall 308, and/or the length and shape of the split(s) 324 are adapted to prevent the intruder reaching for the release connector 140 in a general direction of the track 112 from freeing the connector 140 from the slit 324 and pulling the connector 140 towards the door 102 such as to deflect the lever 132 downwards.

Figure 6A:
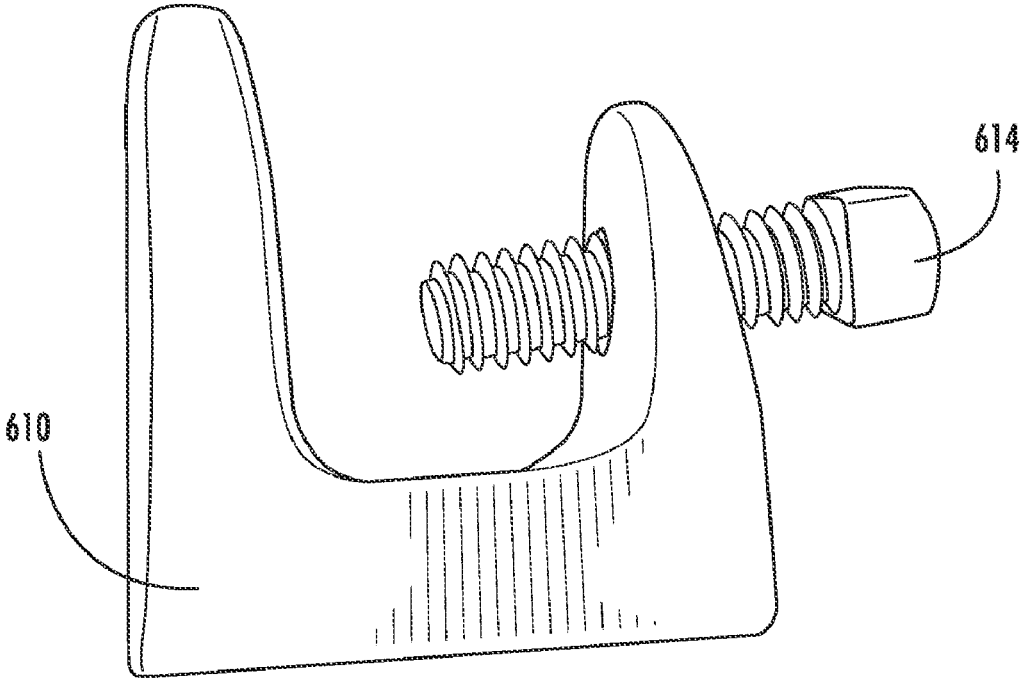
FIGS. 6A, 6B are views of attachment means for use with an embodiment of the invention.
Figure 6B:
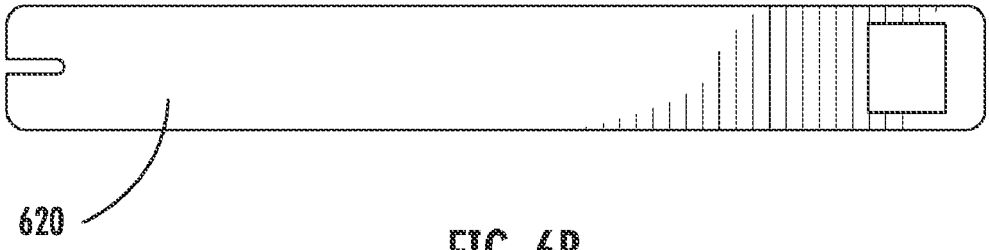

As was mentioned above, the attachment of any protective housing structure to the truck portion of the door-opening assembly adds weight to this truck portion, which may affect the mechanical balance and stability of the system, especially in operation, during the motion of the truck portion along the track of the system. Accordingly, in one embodiment, the protective housing structure is configured to be mounted not to the truck but to an arm of the system connecting the truck to the door. In reference to FIGS. 1A, 1B, and 4A, for example, the embodiment 300 of the housing structure is preferably adapted to be mountable onto the arm 116 of the system 100. Specifically, and in further reference to FIGS. 3A, 3B, the embodiment 300 is equipped with the attachment flap 326 having two component plates and configured to sandwich the flat body of the arm 116 between the component plates. In one embodiment, for example, the separation t between the plates of the flap 326 is substantially equal or slightly bigger than the thickness of the arm 116. Optionally, to affix the housing structure 300 to the arm 116 via the flap 326, an additional housing structure attachment means may be employed. An example of the housing structure attachment means including a clamp 610 having a bolt 614, and a bolt-tightening key 620 is shown in FIGS. 6A and 6B, respectively. One end of the bolt-tightening key 620 is shown to include an opening that is congruous with a head of the bolt 614. The opposite end of the key 620 is shown to include a slot the width of which is approximately equal to the thickness of a wall of the housing structure 300. In practice, the bolt-tightening key 620 can be used as a lever to bend or ply a portion of a wall of the structure 300 such as to adapt the shape of the structure 300 to the specific shape of the connecting arm 116. For example, when the width of the connecting arm 116 is greater than the width of the flap 326, the user may articulate the slot of the key 620 to and over a triangular portion of the housing structure wall (shown in FIG. 6C as the triangular area below the plates 626*a*, 626*b* to provide more room proximate to the flap 326 to accommodate the wide connecting arm.

Figure 6C:
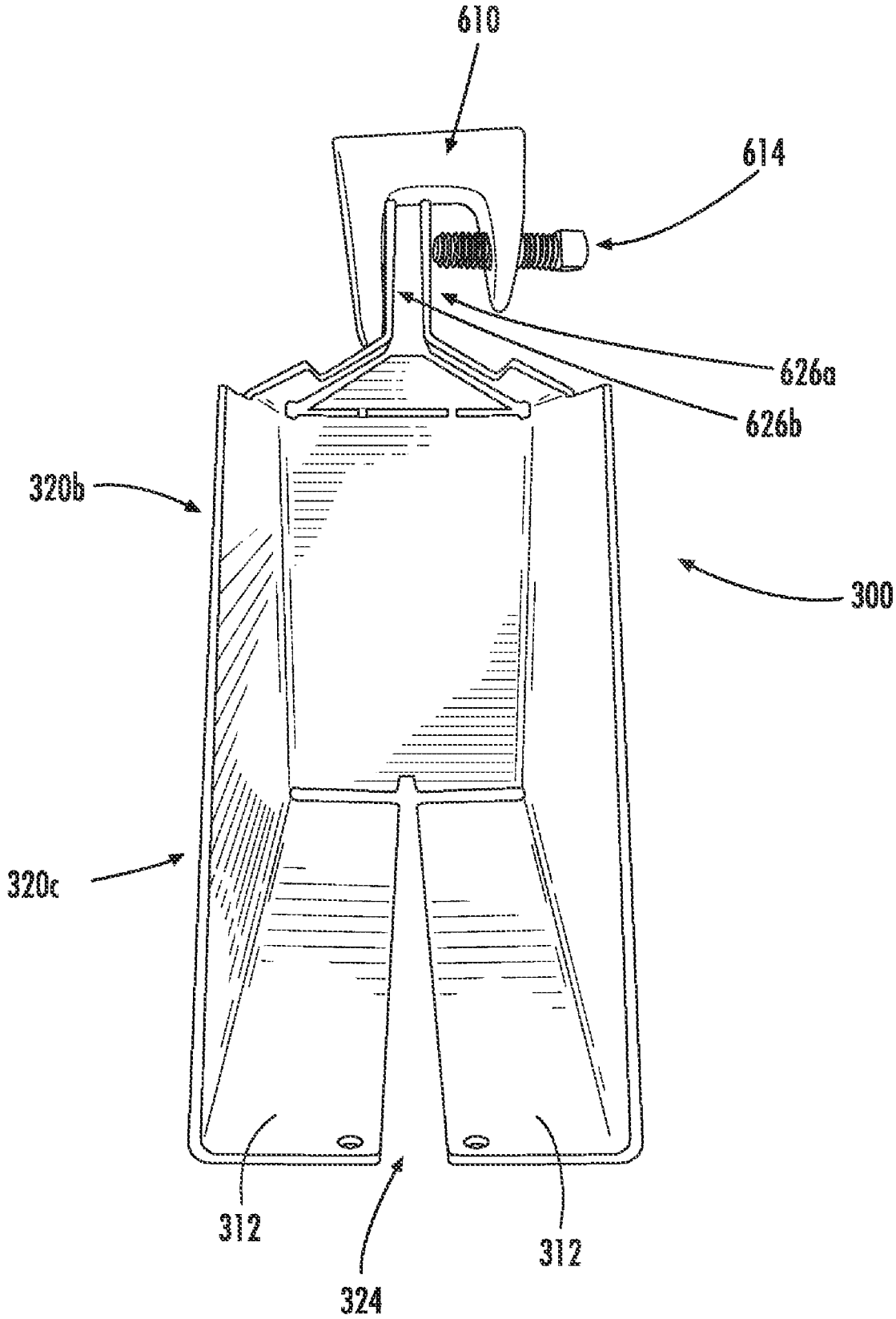
FIG. 6C is a front view of the embodiment of FIGS. 3A, 3B, 3C with the attachment means of FIGS. 6A, 6B articulated thereto.

In reference to FIG. 6C, showing the attachment means including the clamp 610 and the bolt 614 articulated with the attachment flap 326 of the embodiment 300, a portion of the arm 116 that has been inserted (not shown) between plates 626*a*, 626*b* of the flap 326 is further compressed between the plates 626*a*, 626*b* by tightening the grip of the clamp 614 and applying tension with the key 520 against the connecting arm 116. In one embodiment, such attachment is effectuated without a need to extend the bolt 614 through the arm 116 itself. FIG. 4A also clearly identifies such mounting of the housing structure 300 to the arm 116 via the attachment means discussed herein. It is appreciated that, in a related embodiment, the housing structure of the invention may be attached to the truck and that, generally, the means of attachment of the housing structure can differ—the scope of the invention is not limited to a particular configuration of such attachment means. For example, in a related embodiment the security device of the invention is disposed in mechanical communication with the truck with the use of a pin, passing through spatially-coordinated openings in the housing structure and at least one of a portion of the truck or the connecting arm, the ends of which are secured, for example, with clips or nuts.

In practice, therefore, a carriage-assembly or truck based garage-door opening system is protected from highjacking by employing an embodiment of the present invention. Referring again to FIGS. 1A,3A, and 4A, the housing structure of the embodiment is preferably attached to the pulling arm 116 of the door-opening system 100 such as (i) to have the housing structure 300 enclose a portion 110*a* of the truck 110, which is transverse to the track 112 of system 100, the release lever 132, the spring 136, and a portion of the release connector 140 attached to the end of the release lever 132 in the inner volume 306; and (ii) to have the aperture of the housing structure defined by its edges generally face the truck portion, while (iii) having the release connector 140 pass through an opening in the wall 312 such as to allow the connector 140 hang freely outside of the housing structure 300 and be accessible from the garage floor.

An embodiment of the garage door opener guard such as the embodiment 300 can be fabricated from a metallic sheet, for example, that is appropriately cut, stamped, and/or folded to define the housing structure having an inner volume, an aperture providing access to the inner volume, and optional peripheral elements such as, for example, an attachment flap as described above. Alternatively, the embodiment may be assembled from stand-alone components that, when brought in mechanical cooperation, define the above-described structure.

While the invention is described through the above-described examples, it will be understood by those of ordinary skill in the art that modifications to, and variations of, the illustrated embodiments may be made without departing from the inventive concepts disclosed herein. For example, the scope of the invention does not change depending on a particular shape or symmetry of the protective housing structure, the number of walls that it has or orientation of these walls with respect to one another. In a related embodiment, for example, at least one of the walls of the housing structure may not be flat or planar but may be curved. Alternatively or in addition, for example, dihedral angles formed by the walls of an embodiment may differ. Furthermore, disclosed aspects, or portions of these aspects, may be combined in ways not listed above. Accordingly, the invention should not be viewed as being limited to the disclosed embodiment(s).

What is claimed is:

1. A system for opening a door of a garage, the system comprising:

a track extending away from the door;

a truck slidably mounted on the track and connected to the door with a connecting member;

an operating means configured to slide the truck along the track;

a release lever having proximate and distal ends and pivotally connected to the truck at the proximate end, the release lever configured to manually release the door from the operating means;

a housing shell including an inner volume defined by walls of the housing shell, an aperture defined by edges of the housing shell, and an opening in a wall thereof, said aperture dimensioned to receive a portion of the truck and the release lever; and a release connector attached to the distal end of the release lever;

wherein said housing shell is removably disposed in mechanical communication with the release lever such as to enclose the release lever received through the aperture in the inner volume, to cause the release connector to freely extend downward from the distal end of the release lever through the opening and outside of the housing shell, and to prevent a deflection of the release lever when the release connector is pulled towards the door.

2. A system according to claim 1, wherein the housing shell is attached to the connecting member and is tensionable thereagainst.

3. A system according to claim 1, wherein the housing shell is further disposed such as to prevent access to the release lever from the door.

4. A system according to claim 1, wherein the opening in a wall of the housing structure is adapted to entrap the release connector when the release connector is being pulled towards the door.

5. A system according to claim 1, wherein the housing shell is disposed in mechanical communication with the release lever such as to conceal the release lever from being reachable from outside of the housing shell.

6. A system according to claim 1, wherein the housing shell further includes a flap which, when the housing shell is removably disposed in mechanical communication with the release lever such as to enclose the release lever received through the aperture in the inner volume and to cause the release connector to freely extend downward from the distal end of the release lever through the opening and outside of the housing shell, is tensionably affixed to the connecting member.

7. A system according to claim 1, wherein said housing shell is configured to conceal a portion of the truck and the release lever received through the aperture in the inner volume, when disposed in mechanical communication with the release lever, such as to prevent said release lever from being activated from outside of the housing shell.

* * * * *